US009517923B2

(12) United States Patent
Al-Hakim

(10) Patent No.: US 9,517,923 B2
(45) Date of Patent: Dec. 13, 2016

(54) SYSTEM FOR DELIVERING COLD BEVERAGES TO A VEHICLE CABIN

(71) Applicant: Muneer Al-Hakim, Macon, GA (US)

(72) Inventor: Muneer Al-Hakim, Macon, GA (US)

( * ) Notice: Subject to any disclaimer, the term of this patent is extended or adjusted under 35 U.S.C. 154(b) by 0 days.

(21) Appl. No.: 14/870,304

(22) Filed: Sep. 30, 2015

(65) Prior Publication Data

US 2016/0096716 A1 Apr. 7, 2016

Related U.S. Application Data

(60) Provisional application No. 62/058,276, filed on Oct. 1, 2014.

(51) Int. Cl.

| | |
|---|---|
| ***B67D 1/08*** | (2006.01) |
| ***B67D 1/00*** | (2006.01) |
| ***B67D 1/10*** | (2006.01) |
| ***B67D 1/12*** | (2006.01) |

(52) U.S. Cl.

CPC ..... *B67D 1/0894* (2013.01); *B67D 1/0004* (2013.01); *B67D 1/10* (2013.01); *B67D 1/124* (2013.01); *B67D 1/0804* (2013.01); *B67D 2001/0812* (2013.01)

(58) Field of Classification Search

CPC ..... B65D 1/06; B60N 3/18; B67D 1/0894; B67D 1/0004; B67D 1/124; B67D 1/06

USPC ..... 141/113, 349, 356; 215/2

See application file for complete search history.

(56) References Cited

U.S. PATENT DOCUMENTS

| | | | | |
|---|---|---|---|---|
| 4,130,145 | A * | 12/1978 | Thomas, Jr. | B60N 3/18 141/360 |
| 5,497,918 | A * | 3/1996 | Brilanchik | B60N 3/18 123/41.31 |
| 8,763,655 | B2 * | 7/2014 | Springer | A47G 19/2205 141/113 |
| 9,016,333 | B2 * | 4/2015 | Shaffer | B65D 1/04 141/113 |
| 2014/0004241 | A1 * | 1/2014 | Hatherell | B01F 3/04794 426/477 |

* cited by examiner

*Primary Examiner* — Timothy L Maust
*Assistant Examiner* — Timothy P Kelly
(74) *Attorney, Agent, or Firm* — Dunlap Bennett & Ludwig PLLC

(57) ABSTRACT

A beverage delivery system is provided. The system allows a user to easily and repeatedly retrieve a desired volume of refrigerated beverage at a desired temperature and at a desired time all by using one hand and without the need to leave their seat. A container portion houses refrigerated fluid containers and pumps that are fluidly interconnected to a cup holder and cup. The cup received in the cup holder may be moved from an inactive configuration to an active configuration, selectively delivering refrigerated fluid from the container portion's fluid containers and through the bottom plate of the cup, which is sealed in the inactive configuration.

2 Claims, 7 Drawing Sheets

SYSTEM FOR DELIVERING COLD BEVERAGES TO A VEHICLE CABIN

CROSS-REFERENCE TO RELATED APPLICATION

This application claims the benefit of priority of U.S. provisional application No. 62/058,276, filed 1 Oct. 2014, the contents of which are herein incorporated by reference.

BACKGROUND OF THE INVENTION

The present invention relates to beverage delivery system and, more particularly, to a beverage delivery system for delivering cold beverages to a vehicle cabin.

Currently, there are two main ways to dispense cold drinks inside a driver's cabin or inside the vehicle's cabin area. These two main ways include a cup with ice, or a small refrigerator or cooler with bottled drinks. Both of these ways have disadvantages, limitations and inconveniences. The cup with ice needs to be filled and refilled with ice and a beverage, each from their separate containers that each need to be separately handled along with the cup itself; likely requiring the consumer to leave the confines of their seat. Also ice tends to melt quickly, diluting the beverage, and allowing it to become warm. With refrigerators/coolers, once the bottled drink is removed therefrom its entire contents become warmer so that a substantial portion at the bottom of the bottle may become unappetizingly warm. Also, refrigerator/cooler takes up space that may be needed for legroom or storage space, especially on long trips. Moreover, the driver or passenger may have to leave their seat to reach the refrigerator/cooler based on its location.

As can be seen, there is a need for a beverage delivery system for delivering cold beverages to a vehicle cabin.

SUMMARY OF THE INVENTION

In one aspect of the present invention, a liquid delivery system includes a cup holder having a base plate and at least one sidewall forming a holder cavity; and at least one pipe chamber extending from the base plate so as to protrude into the holder cavity; and a cup having a cup base plate forming at least one plate hole aligned with the at least one pipe chamber; and a valve attached to the base plate so as to be biased in sealing the at least one cavity hole in a sealed configuration, wherein the valve is adapted to be urgeable into a flow configuration allowing fluid through the at least one cavity hole, wherein an active configuration the at least one pipe chamber slidably protrudes through the at least one plate hole, urged the valve to the flow configuration.

These and other features, aspects and advantages of the present invention will become better understood with reference to the following drawings, description and claims.

DETAILED DESCRIPTION OF THE INVENTION

Figure 1:
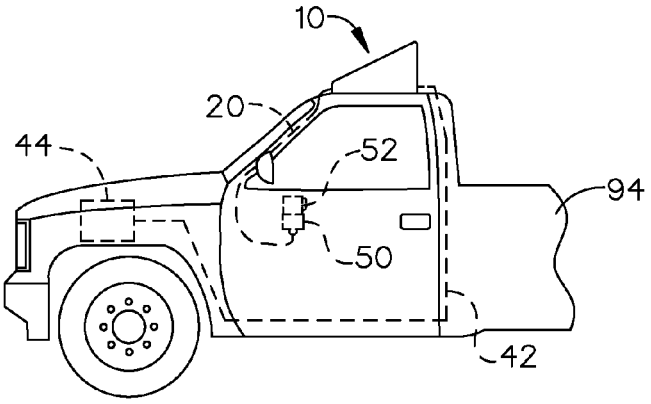
FIG. 1 is a schematic view of an exemplary embodiment of the present invention.
Figure 2:
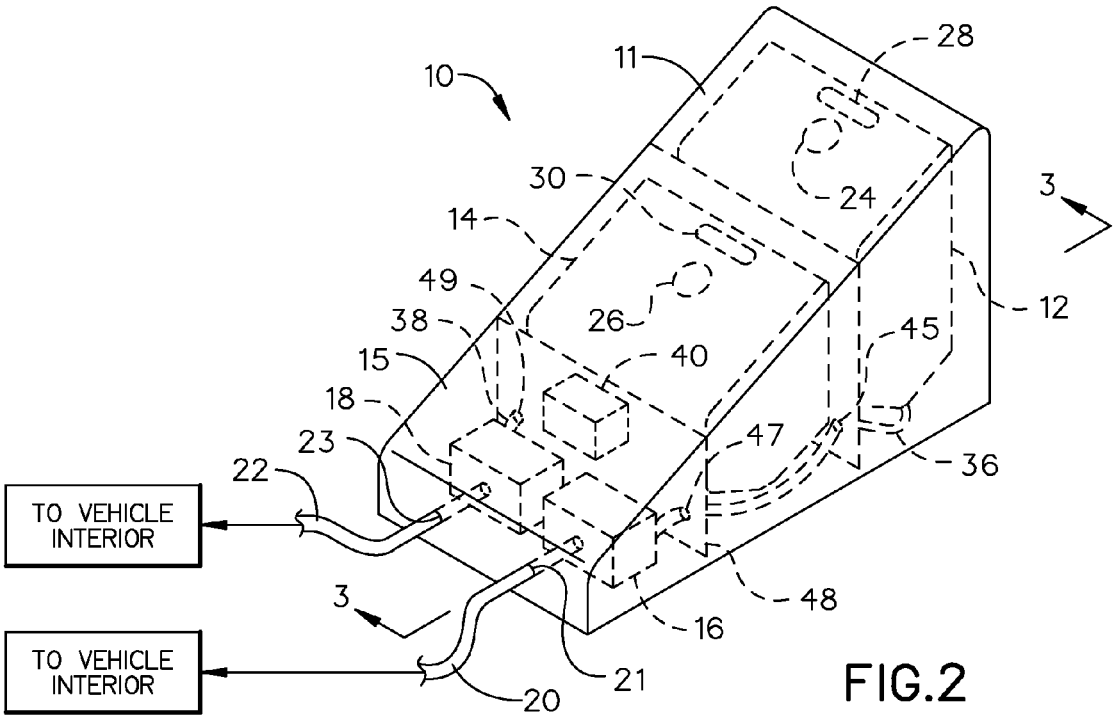
FIG. 2 is a perspective view of a container portion of an exemplary embodiment of the present invention.
Figure 3:
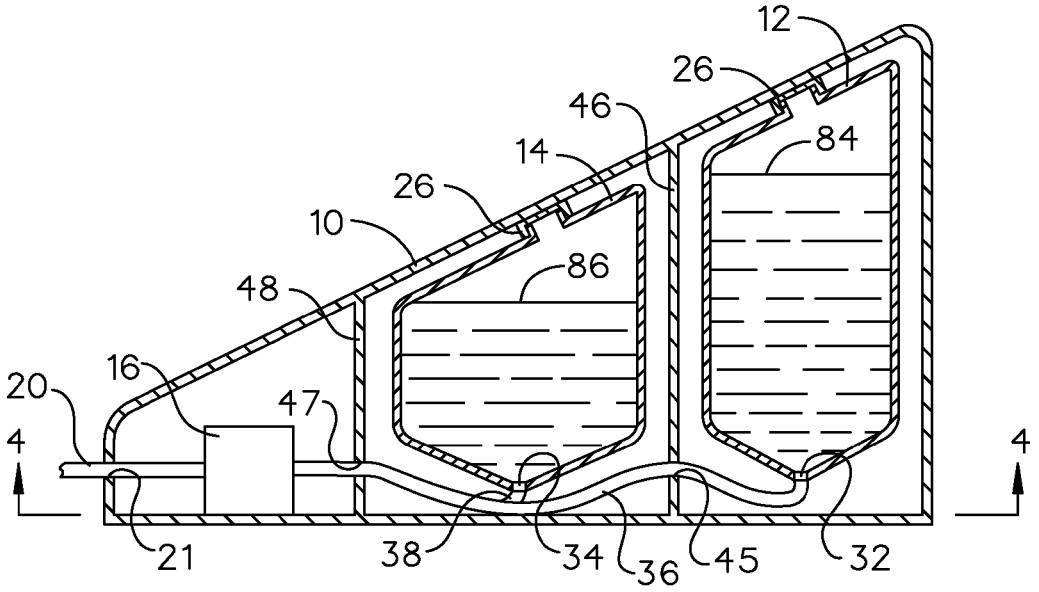
FIG. 3 is a section view of an exemplary embodiment of the present invention, taken along line 3-3 in FIG. 2.
Figure 4:
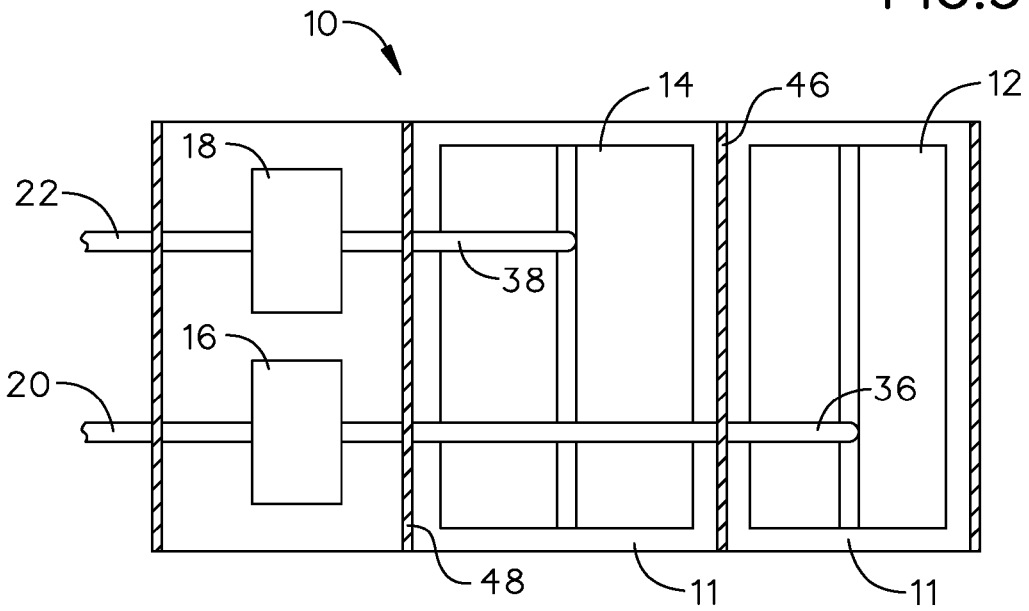
FIG. 4 is a section view of an exemplary embodiment of the present invention, taken along line 4-4 in FIG. 3.
Figure 5:
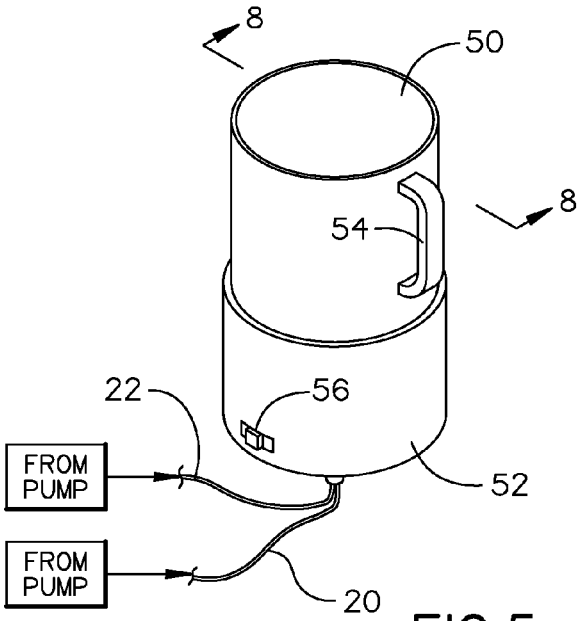
FIG. 5 is a perspective view of a cup and a cup holder portion of an exemplary embodiment of the present invention.
Figure 6:
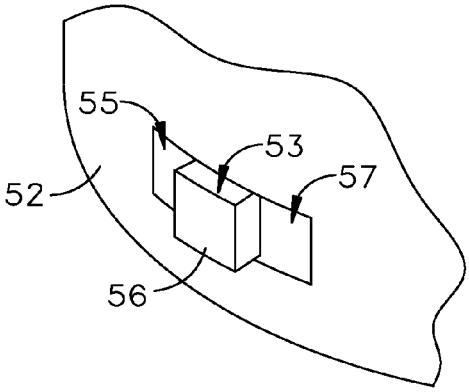
FIG. 6 is a detail perspective view of a switch of an exemplary embodiment of the present invention, shown in an off position.
Figure 7:
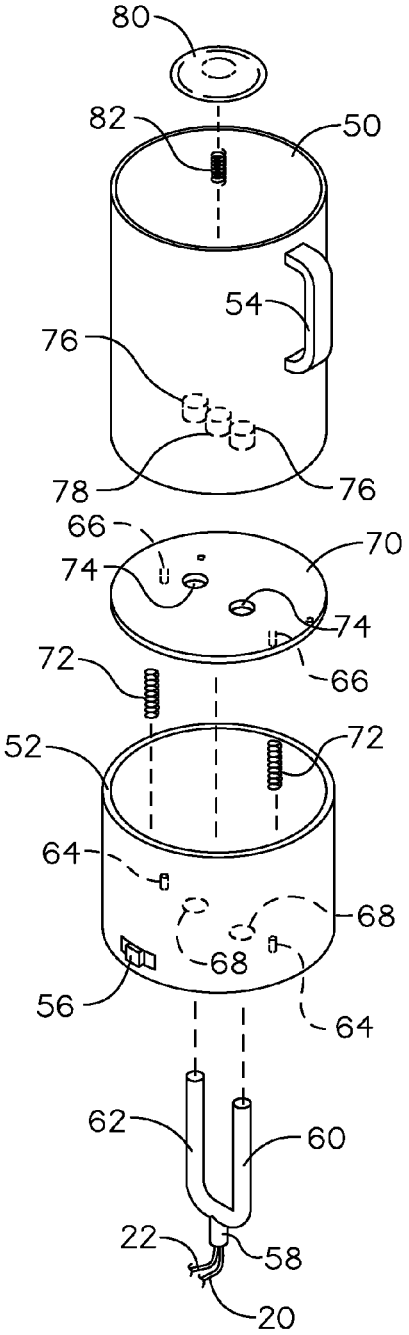
FIG. 7 is an exploded view of the cup and the cup holder portion of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a beverage delivery system allowing a user to easily and repeatedly retrieve a desired volume of refrigerated beverage at a desired temperature and at a desired time all by using one hand and without the need to leave their seat. A container portion houses refrigerated fluid containers and pumps that are fluidly interconnected to a cup holder and cup. The cup received in the cup holder may be moved from an inactive configuration to an active configuration, selectively delivering refrigerated fluid from the container portion's fluid containers and through the bottom plate of the cup, which is sealed in the inactive configuration.

As is illustrated in FIGS. 1 through 10, a system for delivering cold beverages to a vehicle cabin may include a container 10 housing a refrigerated compartment 11 and a pump compartment 15 separated by a first divider wall 46. The refrigerated compartment 11 may house a first fluid container 12 and a second fluid container 14 separated by a second divider wall 48. The first fluid container 12 may form a cavity dimensioned and adapted to receive a first fluid 84. The second fluid container 14 may form a cavity dimensioned and adapted to receive a second fluid 86. The first fluid container 12 may include a first container cap 24 and a first container handle 28, and the second fluid container 14 may include a second container cap 26 and a second container handle 30. On a lower side of the first fluid container 12 and the second fluid container 14, there may be a first opening 32 and a second opening 34, respectively.

The pump compartment 15 may include at least a first pump 16. In certain embodiments, a second pump 18 may also be included in the pump compartment 15. A first container pump tube 36 may fluidly connect the cavity of the first fluid container 12 (via the first opening 32) to the first pump 16 by, in certain embodiments, passing through a rear divider tube slot 45 and a front divider first tube slot 47. A second container pump tube 38 may fluidly connect the cavity of the second fluid container 14 (via the second opening 34) to the second pump 18 by, in certain embodiments, passing through a front divider second tube slot 49.

A first outflow tube 20 may fluidly connect to the first pump 16 through a first tube slot 21 along the container 10 and a second outflow tube 22 may fluidly connect to the second pump 18 through a second tube slot 23 along the container 10. In certain embodiments, the pump compartment 15 may also include a back up battery 40. A top wall of the container 10 may be opened by lifting it up and to the side which may expose the refrigerator compartment 11 and the pump compartment 15 inside.

A power source 44 may be located in the engine area of a vehicle 90, 94, 96 and may connect to the container 10, an alternate container 92 or the like, through a power line 42 so as to power the pumps 16, 18.

The first outflow tube 20 and the second outflow tube 22 may fluidly connect to a cup holder 52. In certain embodiments, the first outflow tube 20 and the second outflow tube 22 may fluidly connect to a receiving end of a forked dispensing pipe 58 interconnecting to the cup holder 52, wherein the receiving end may split into a first dispensing pipe chamber 60 and a second dispensing pipe chamber 62. In certain embodiments, between the receiving end and the two pipe chambers 60, 62 a first check valve 61 and a second check valve 63 may be disposed at the end of the first outflow tube 20 and the second outflow tube 22, respectively.

The cup holder 52 may include a switch 56. The switch 56 may be adapted to be selectively positioned between a first pump position 55, a second pump position 57, and an off position 53. In the first pump position 53, the switch 56 may enable the first pump 20 to be operable, wherein in the second position 57 the switch may enable the second pump 22 to be operable, and in the off position 53 the switch 56 may be adapted so that both pumps 20, 22 may be inoperable so as to prevent accidental and unintentional use.

The cup holder 52 may include a base plate 67 and at least one sidewall forming a holder cavity dimensioned and adapted for receiving a cup 50. The base plate 67 may form two cavity holes 68 dimensioned and adapted to slidably receive the two pipe chambers 60, 62 into the holder cavity. At least one lower connector 64 may be disposed on the base plate 67 so as to protrude into the holder cavity. The cup holder 52 may include a compression plate 70 dimensioned and adapted to snugly engage the sidewalls thereof. The compression plate 70 may form two pipe holes 74 dimensioned and adapted to slidably receive the two pipe chambers 60, 62 and thereby align with the two cavity holes 68.

At least one upper connector 66 may be disposed on the compression plate 70 so as to align and face the at least one lower connector 64. The at least one upper connector 66 and the at least one lower connector 64 may be adapted so that while in an active configurations, when physically engaging each other, the first or second pump 16 or 18 made operable by the switch 56 is activated. At least one spring mechanism 72, like a compression spring, may be placed between the compression plate 70 and the base plate 67, spring-biasing the former in an inactive configuration deactivating the pumps 16, 18. The compression plate 70, pipe holes 74 and the spring mechanism 72 may be seen as a spring biasing mechanism biasing the cup holder 52 in an inactive configuration.

Figure 8:
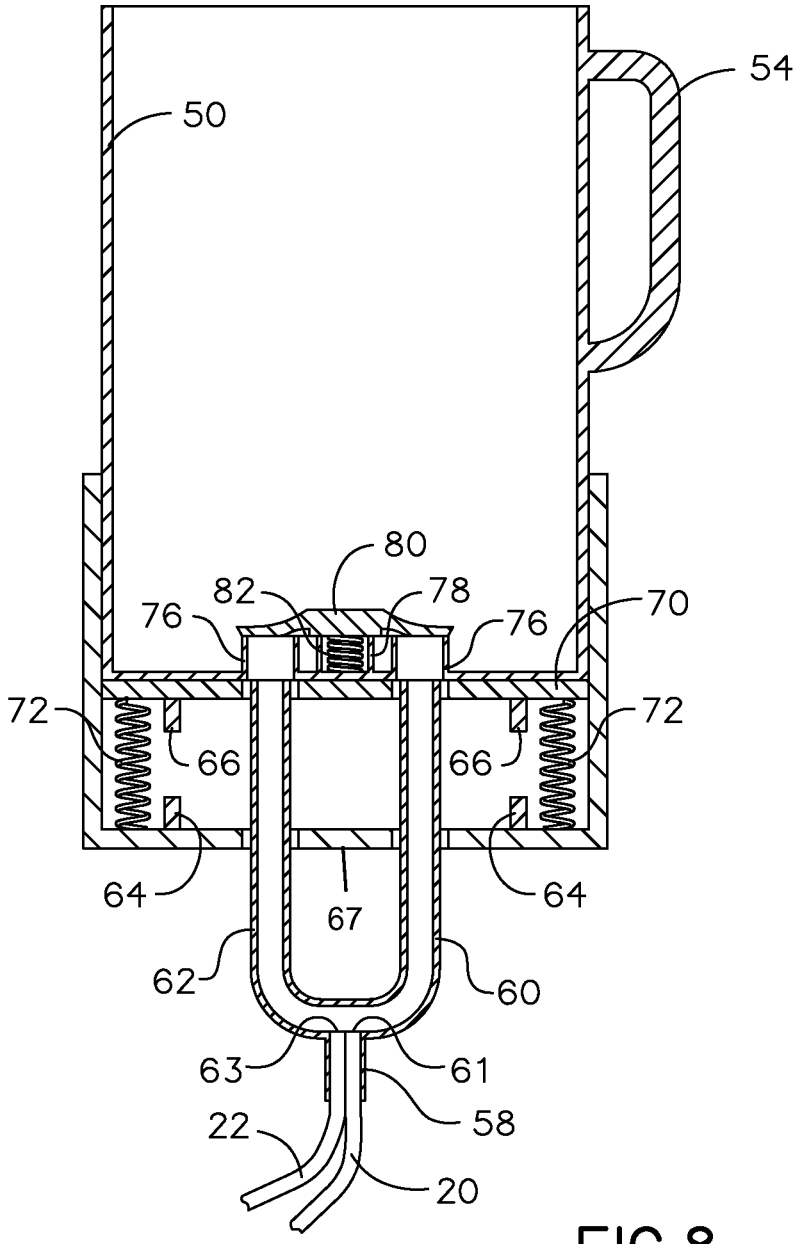
FIG. 8 is a section view of an exemplary embodiment of the cup and the cup holder portion in an inactive configuration of the present invention, taken along line 8-8 in FIG. 4.

The cup 50 may be dimensioned to slide into the cup cavity of the cup holder 52, as illustrated in FIGS. 5-10. In certain embodiments, the cup 50 may include a cup handle 54. The cup 50 may have a cup sidewall and a cup base plate 69 forming a cup cavity for receiving a fluid. Two plate openings with sleeves (or two sleeved openings) 76 may be formed in the cup base plate 69 so as to align with the two pipe holes 74 and the two cavity holes 68. A cup spring chamber 78 may be disposed on the cup base plate 69 between the two spaced apart sleeved openings 76. A tension valve spring 82 may be received within the cup spring chamber 78 and securely attached to the bottom thereof. In certain embodiments, the sleeves of the sleeved opening form a gap into which the spring may be disposed in an unloaded state. A valve 80 may be placed above and be operably attached to the valve spring 82. The valve 80 may be an umbrella valve dimensioned and adapted to seal off the two sleeved openings 76 and the cup spring chamber 78, as illustrated in FIG. 8. A peripheral portion of the valve 80 may be biased in a sealed configuration, sealing the two sleeved openings 76, but adapted so that the peripheral portion may be urged to a flow configuration when subject to a sufficient pressure, as illustrated in FIGS. 9A and 9B, and then reverting to the sealed configuration in the absence of sufficient pressure.

Figure 9A:
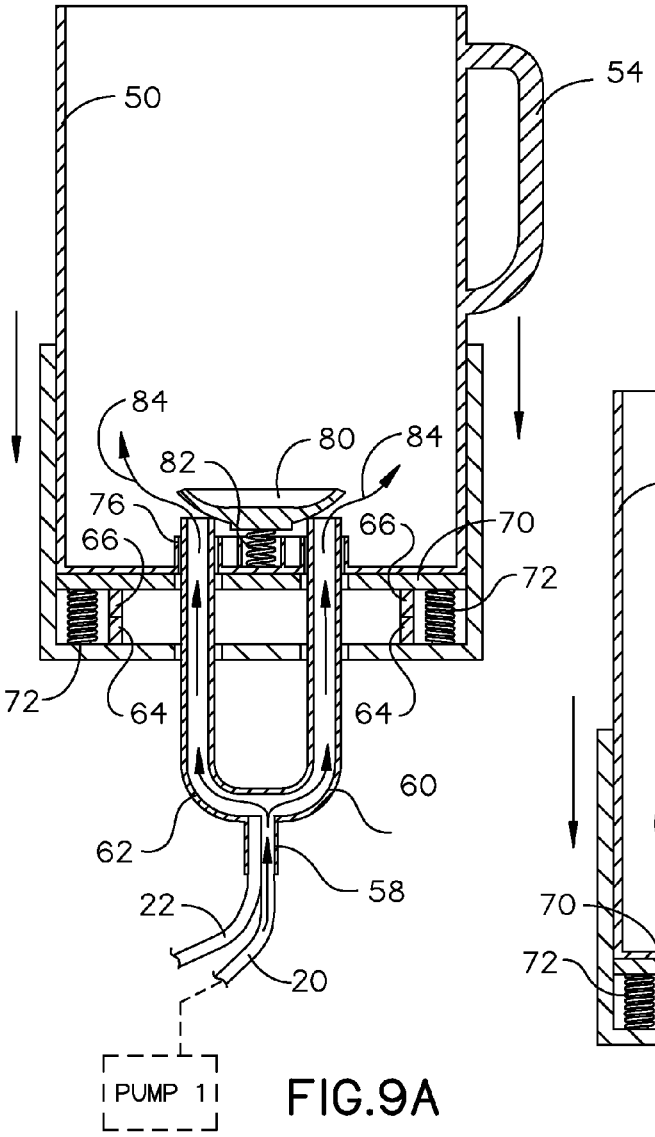
FIG. 9A is a section view of an exemplary embodiment of the present invention, illustrating the cup and the cup holder portion in an active configuration with the switch set to a first position.
Figure 9B:
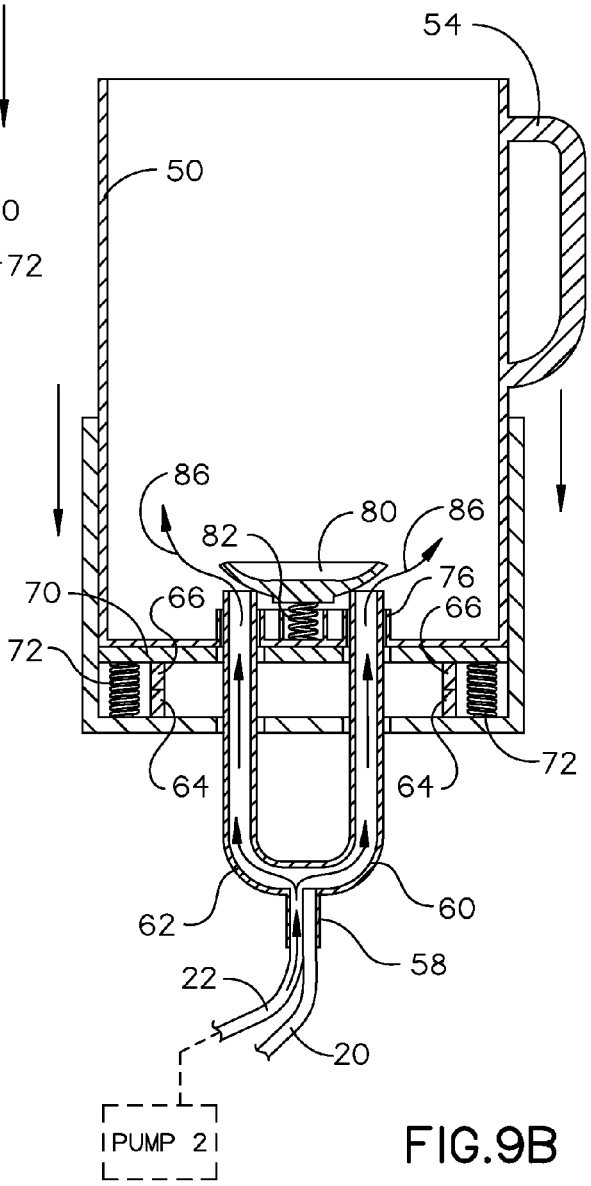
FIG. 9B is a section view of an exemplary embodiment of the present invention, illustrating the cup and the cup holder portion in the active configuration with a switch set to a second position.
Figure 10:
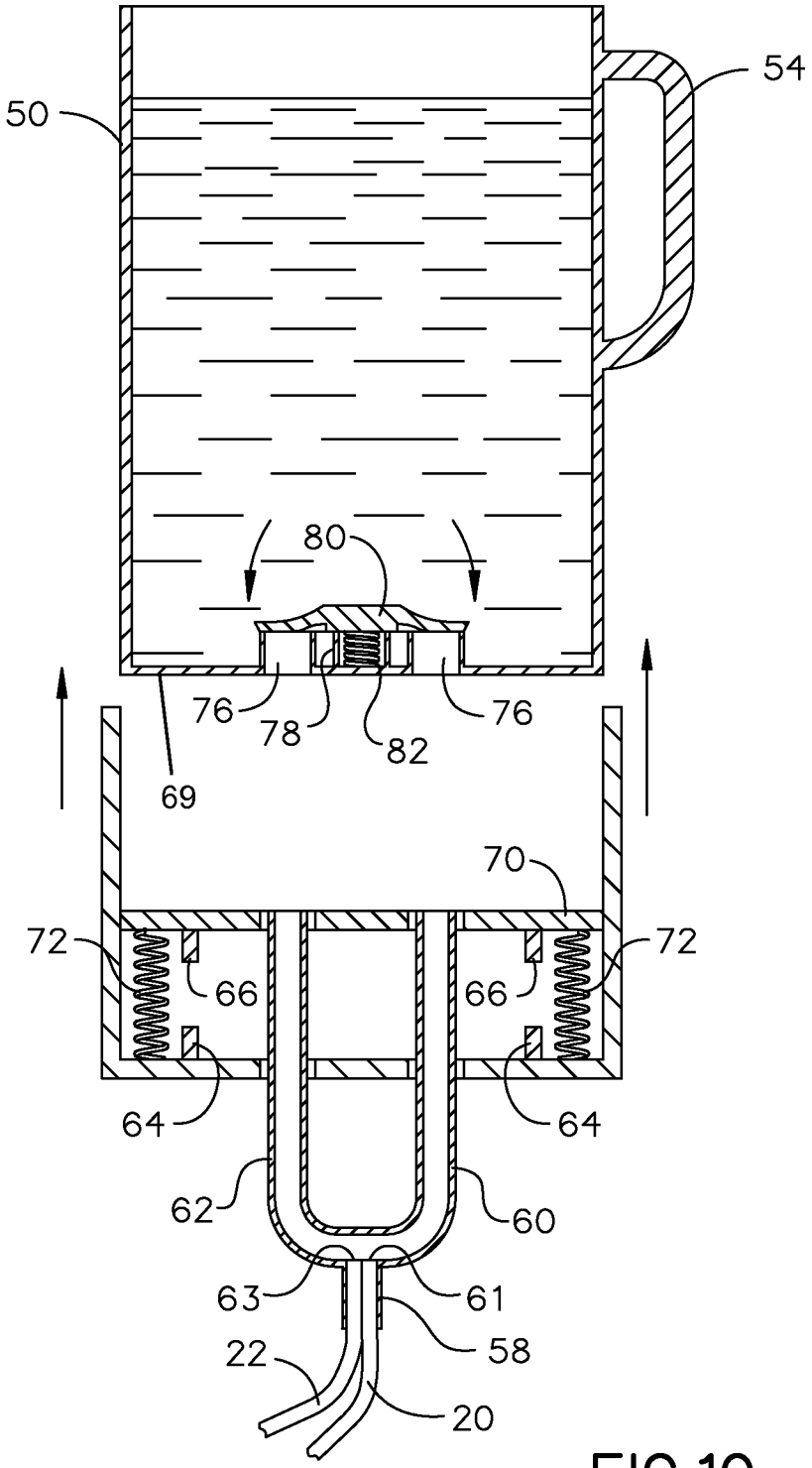
FIG. 10 is a section view of an exemplary embodiment of the present invention, illustrating the cup being removed from the cup holder.
Figure 11:
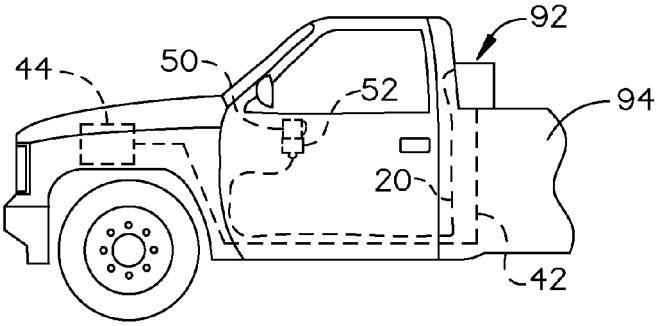
FIG. 11 is a schematic view of an alternate embodiment of the present invention.
Figure 12:
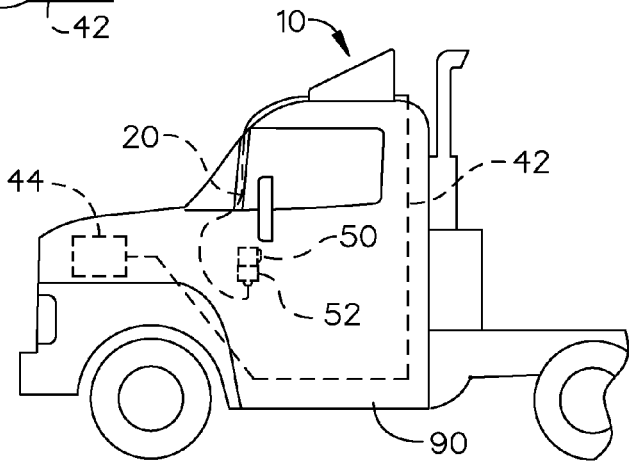
FIG. 12 is a schematic view of an alternate embodiment of the present invention.
Figure 13:
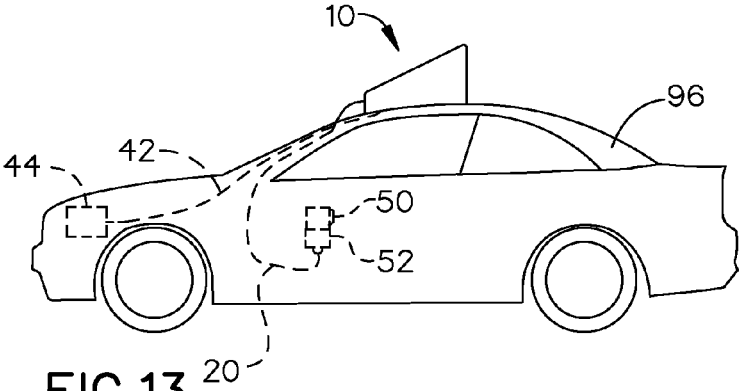
FIG. 13 is a schematic view of an alternate embodiment of the present invention.
Figure 14:
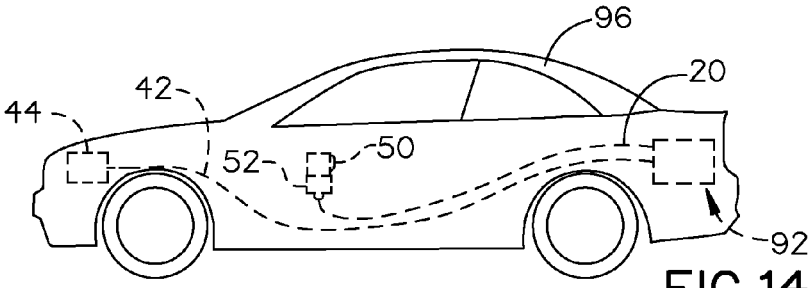
FIG. 14 is a schematic view of an alternate embodiment of the present invention.

When the cup 50 may be placed inside the cup holder 52 and urged downwardly onto the spring biased compression plate 70, the latter may be urged downwardly into the active configuration, activating the first pump 16 or the second pump 18 if switch-operable. Also in the active configuration, the pipe chambers 60, 62 may extend through the two sleeved openings 76 so as to urge the peripheral portion of the valve 80 into the flow configuration, allowing pulped first fluid 84 and/or the second fluid 86 into the cup cavity of the cup 50, as illustrated in FIGS. 9A and 9B. When the cup cavity receives a desired volume of fluid, the user may cease to urge the cup 50 downwardly so that the spring-biased compression plate 70 moves to the inactive configuration, disengaging the connectors 64, 66, whereby the first pump 16 and the second pump 18 are inactive. In the inactive configuration, after fluid occupies the cup cavity, the pipe chambers 60, 62 no longer protrude through the two sleeved openings 76, allowing the peripheral portion of the valve 80 (with the help of the tension valve spring 82) to move to the sealed configuration, sealing off the two sleeved openings 76 and thus preventing leaking therefrom, as illustrated in FIG. 10.

Referring to FIGS. 11 through 14, the container 10 may be mounted on a roof of the vehicle 90, 94, 96. The container 10 may be attached to a roof rack using fasteners. The container 10 may be of an aerodynamic structure so that the air flow may meet minimal resistance. The container 10 may also be mounted in a back truck of the vehicle 90, 94, 96. The first container cap 24 and the second container cap 26 may be removed in order to fill the first fluid container 12 and the second fluid container 14 with the desired liquid. In certain embodiments, the first outflow tube 20 and the second outflow tube 22 may exit the first pump 16 and the second pump 18 respectively and may enter the vehicle's cabin through the driver's side anterior pillar, and travel behind the dash and into the cup holder 52.

It should be understood, of course, that the foregoing relates to exemplary embodiments of the invention and that modifications may be made without departing from the spirit and scope of the invention as set forth in the following claims.

What is claimed is:

1. A liquid delivery system, comprising:

a cup holder comprising:

a holder base plate and at least one sidewall forming a holder cavity; and at least one pipe chamber extending from the base plate so as to protrude into the holder cavity; and a cup comprising:

a cup base plate forming at least one plate hole aligned with the at least one pipe chamber; and a valve attached to the cup base plate so as to be biased in a sealed configuration, sealing the at least one plate hole, wherein the valve is adapted to be urgeable into a flow configuration allowing fluid through the at least one plate hole;

a spring biasing mechanism biasing the cup holder in an inactive configuration;

at least one first connector disposed along the holder base plate so as to protrude into the holder cavity;

a compression plate within the holder cavity, wherein the compression plate forms at least one pipe hole aligned with the at least one cavity hole;

at least one second connector disposed along the compression plate so as to face and be aligned with the at least one first connector; and the spring mechanism disposed between the holder base plate and the compression plate so that the compression plate is biased in the inactive configuration yet movable so that the first and second connectors engage in the active configuration, wherein in an active configuration the at least one pipe chamber slidably protrudes through the at least one plate hole, and the valve is urged to the flow configuration.

2. The liquid delivery system of claim 1, further comprising at least one cavity hole formed in the holder base plate for the at least one pipe chamber to protrude through.

* * * * *